US012692787B2

(12) United States Patent
El-Khoury et al.

(10) Patent No.: US 12,692,787 B2
(45) Date of Patent: Jul. 28, 2026

(54) SIDEWALL CORING TOOLS HAVING ACTIVE CIRCULATION FEATURES

(71) Applicant: SCHLUMBERGER TECHNOLOGY CORPORATION, Sugar Land, TX (US)

(72) Inventors: Jules El-Khoury, Houston, TX (US); Anish Kumar, Houston, TX (US); Christopher Albert Babin, Waveland, MS (US); Khaled Hadj-Sassi, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 258 days.

(21) Appl. No.: 18/632,013

(22) Filed: Apr. 10, 2024

(65) Prior Publication Data

US 2025/0320816 A1 Oct. 16, 2025

(51) Int. Cl.

| | |
|---|---|
| ***E21B 49/06*** | (2006.01) |
| ***E21B 21/08*** | (2006.01) |
| ***E21B 25/10*** | (2006.01) |
| ***E21B 49/10*** | (2006.01) |

(52) U.S. Cl.

CPC ..... *E21B 49/10* (2013.01); *E21B 21/08* (2013.01); *E21B 25/10* (2013.01)

(58) Field of Classification Search

CPC ..... E21B 49/10; E21B 21/08; E21B 25/10; E21B 10/02; E21B 49/06

USPC ..... 73/152.01, 152.11, 864.31, 864.44, 73/864.45; 175/20, 44, 58

See application file for complete search history.

(56) References Cited

U.S. PATENT DOCUMENTS

| | | | | |
|---|---|---|---|---|
| 11,655,710 B1 * | 5/2023 | Almorihil | ..... | E21B 49/06 166/250.01 |
| 2024/0053319 A1 * | 2/2024 | Anifowose | ..... | G01N 25/20 |

FOREIGN PATENT DOCUMENTS

| | | | | |
|---|---|---|---|---|
| WO | WO-2018017103 A1 * | 1/2018 | ..... | E21B 49/06 |

* cited by examiner

*Primary Examiner* — Robert R Raevis
(74) *Attorney, Agent, or Firm* — Kyle R. Miiller

(57) ABSTRACT

Systems and methods presented herein include sidewall coring tools with active circulation caused by bi-directional downhole pump modules included in the sidewall coring tools. The active flow of mud through the sidewall coring tools may be adjustable in substantially real time during coring operations performed by the sidewall coring tools. In general, the ability to actively control the flow of mud through the sidewall coring tools enables lubrication and assists in moving cuttings during coring operations away from the coring bit.

20 Claims, 4 Drawing Sheets

SIDEWALL CORING TOOLS HAVING ACTIVE CIRCULATION FEATURES

BACKGROUND

The present disclosure relates generally to systems and methods that include sidewall coring tools with active circulation caused by bi-directional downhole pump modules included in the sidewall coring tools.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

The oil and gas industry includes a number of sub-industries, such as exploration, drilling, logging, extraction, transportation, refinement, retail, and so forth. During exploration and drilling, wellbores may be drilled into the ground for reasons that may include discovery, observation, and/or extraction of resources. These resources may include oil, gas, water, or any other combination of elements within the ground.

Wellbores or boreholes may be drilled to, for example, locate and produce hydrocarbons. During a well development operation, it may be desirable to evaluate and/or measure properties of encountered formations, formation fluids and/or formation gasses. Some formation evaluations may include extracting a core sample (e.g., a rock sample) from the sidewall of a wellbore. Core samples may be extracted using a coring tool coupled to a downhole tool that is lowered into the wellbore and positioned adjacent a formation. A hollow coring shaft or bit of the coring tool may be extended from the downhole tool and urged against the formation to penetrate the formation. A formation or core sample fills the hollow portion or cavity of the coring shaft and the coring shaft is removed from the formation retaining the sample within the cavity.

The sample obtained using the hollow coring bit is generally referred to as a "core sample" or "core plug." Once the core sample has been transported to the surface, it may be analyzed to assess, among other things, the reservoir storage capacity (e.g., porosity) and the flow potential (e.g., permeability) of the material that makes up the formation; the chemical and mineral composition of the fluids and mineral deposits contained in the pores of the formation; and the irreducible water content of the formation material. The information obtained from analysis of a sample is used to design and implement well completion and production facilities.

SUMMARY

A summary of certain embodiments described herein is set forth below. It should be understood that these aspects are presented merely to provide the reader with a brief summary of these certain embodiments and that these aspects are not intended to limit the scope of this disclosure.

The systems and methods presented herein include a sidewall coring tool assembly that includes a coring module configured to perform a sidewall coring operation to extract a core sample from a formation adjacent a borehole within which the sidewall coring tool assembly is disposed. The sidewall coring tool assembly also includes a downhole pumping module configured to control a flow of fluid through the coring module.

The systems and methods presented herein also include a coring system that includes a sidewall coring tool assembly. The sidewall coring tool assembly includes a coring module configured to perform a sidewall coring operation to extract a core sample from a formation adjacent a borehole within which the sidewall coring tool assembly is disposed. The sidewall coring tool assembly also includes a downhole pumping module configured to control a flow of fluid through the coring module. The coring system also includes a surface unit configured to send control signals to the downhole pumping module automatically adjust operating parameters of the downhole pumping module.

The systems and methods presented herein further include a sidewall coring tool assembly that includes a coring module configured to perform a sidewall coring operation to extract a core sample from a formation adjacent a borehole within which the sidewall coring tool assembly is disposed. The sidewall coring tool assembly also includes a downhole pumping module configured to bi-directionally control a flow of fluid through the coring module.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
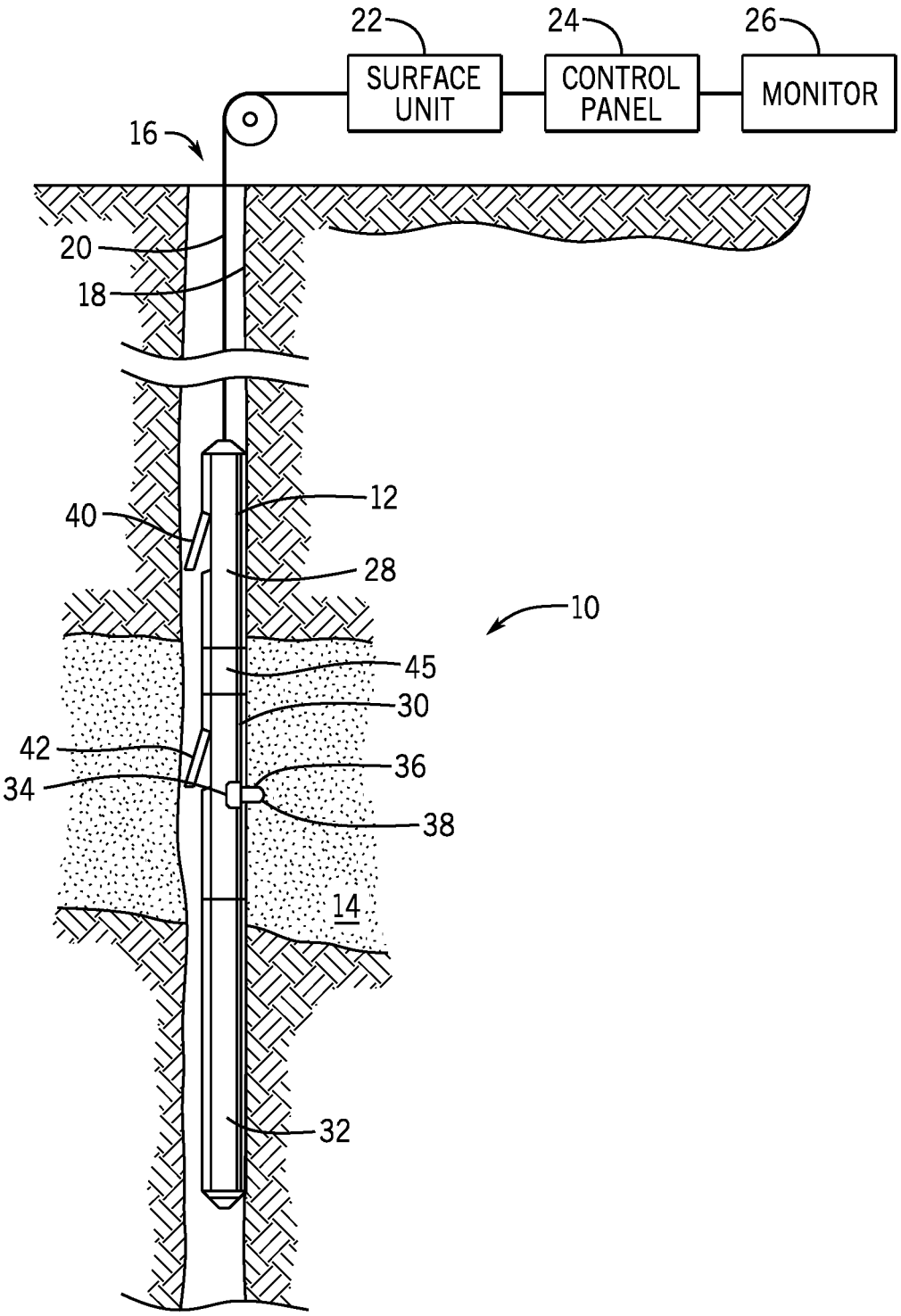
FIG. 1 is a schematic view of an embodiment of a coring system, according to one or more embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements; in other words, these terms are used in an open-ended fashion, and thus should be interpreted to mean "including, but not limited to . . . ." Additionally, it should be understood that references to "one embodiment" or "an embodiment" of the present disclosure are not intended to be interpreted as excluding the existence of additional embodiments that also incorporate the recited features. Furthermore, the phrase "A based on B" is intended to mean that A is at least partially based on B. Moreover, unless expressly stated otherwise, the term "or" is intended to be inclusive (e.g., logical OR) and not exclusive (e.g., logical XOR). In other words, the phrase "A or B" is intended to mean A, B, or both A and B.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

As used herein, "defined flow" or "directed flow" or "active flow" generally refer to the purposeful movement of a fluid (e.g., mud) created by introduction of certain design features (e.g., the scoops, internal grooves, fins, and so forth, described herein) that function, for example, to draw mud in a borehole from one axial end of a coring shaft into an interior space of the coring shaft and to urge the mud to move axially towards a coring bit associated with the coring shaft. As the mud flows over and around the coring bit, it carries cuttings and heat with it. Then, as the mud moves along an outer diameter of the coring bit and the coring shaft, it may be further assisted or guided using external fins, as described in greater detail herein.

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed or are caused to be performed, for example, by a processing system (i.e., solely by the processing system, without human intervention).

As described above, mechanical sidewall coring tools use a coring bit to cut into an annular space in the wellbore to create a cylindrical core sample or plug that can be extracted to the surface. A plurality of core samples or plugs can be cut and stored (usually sequentially) and returned to the surface for analysis. In general, the core plug is created by rotating and applying weight on an annular coring bit with cutting elements on the crown. This activity breaks the rock and cuttings are created. The rock cutting process at the rock bit interface generates heat. This heat, if not removed, has been shown to cause cutter degradation, relatively poor cutting performance, and reduction in cutter life. In addition, discoloration of the bit body has been observed in lab tests and in downhole coring operations, indicating poor heat removal and heat build-up. In some lab experiments, it has been observed that such heat build-up may de-hydrate the mud and burn the rock at the cutting face. Under certain conditions, this may result in bit stalling. In certain embodiments, a flow of fluid (usually drilling mud) is used to cool the tooling and move cuttings away from the bit face to make the cutting operation more efficient.

Typical mechanical sidewall coring tools cannot produce an active flow to the bit face. As such, the coring operation is conducted in a static mud environment using the rotation of the coring shaft and coring bit to encourage passive flow of the fluids and debris. In most cases, the wellbore pressure is higher than the formation pressure. When the coring bit exposes new rock, the wellbore fluids tend to move toward the fresh rock resulting in mud solids building up to form a seal known as mudcake. In addition, as new rock is exposed, fluids and solids also tend to move into the pores of the newly exposed rock and combined with the mudcake can make it difficult to move debris away from the bit face.

In addition, the lack of fluid flow to flush cuttings combined with a relatively small cross-sectional area for the movement of cuttings away from the bit face can result in bit stalling and jamming. For the cuttings that do move away from the bit face and into the space around the bit shaft, the lack of volume can cause cuttings to accumulate, resulting in drag on the bit, which reduces the torque passes to the bit face and increases the chance of jamming. As such, there is a need to provide a coring bit that allows the cuttings to pass through and move away from the bit face. The embodiments described herein reduce parasitic torque from the cuttings buildup at the bit face as well on the bit shaft outer and inner diameter.

In addition, sidewall coring tools typically have a mechanical prime mover (e.g., a hydraulic coring motor) to generate rotary power. This rotary power is transferred to the coring bit or rock cutting bit through the coring shaft of the sidewall coring tool. The coring bit drills into the formation with cutting elements made of a relatively hard material like diamonds. At the end of its stroke, the coring bit breaks the core sample off from the formation. The core sample can be temporarily stored inside the bit and shaft assembly before it is deposited into a core storage tube. In certain embodiments, a hydraulic circuit may activate and deactivate hydraulic pistons to manipulate the combined assembly of coring motor, coring shaft, and the coring bit to cut, break, retrieve, and store the core sample or plug.

As described in greater detail herein, embodiments of the present disclosure modify or add a downhole bi-directional pump to a sidewall coring tool assembly in order to move fluid from the annulus between the sidewall coring tool assembly and the wellbore to the coring bit of the sidewall coring tool assembly and/or the recessed cavity where the coring bit resides before it is deployed. The mud flow acts as lubrication and assists in moving the cuttings during coring operations away from the coring bit and helping with clean-up. In certain embodiments, the pumping rates may be adjustable in order to, for example, reduce the flow when coring relatively soft formations and increase flow when coring relatively hard formations. In certain embodiments, before coring operations, mud flow enters from the wellbore, passes through screens to remove relatively large debris, and is pushed to the coring bit receptacle to flush any accumulated debris during the trip in the hole or between stations.

Referring now to the drawings, FIG. 1 is a schematic view of an embodiment of a coring system 10 utilizing a sidewall coring tool assembly 12 as described in greater detail herein. As illustrated, the sidewall coring tool assembly 12 may be used in a drilled well to obtain core samples from a downhole or subterranean geologic formation 14. In operation, the sidewall coring tool assembly 12 may be lowered into a borehole 16 defined by a bore wall 18, commonly referred to as the sidewall 18. As illustrated, in certain embodiments, the sidewall coring tool assembly 12 may be connected by one or more electrically conducting cables 20 (e.g., wireline cables) to a surface unit 22, which may include (or otherwise be operatively coupled to) a control panel 24 and a monitor 26. In general, the surface unit 22 is configured to provide electrical power to the sidewall coring tool assembly 12, to monitor the status of downhole coring and activities of other downhole equipment, and to control the activities of the sidewall coring tool assembly 12 and other downhole equipment. While FIG. 1 illustrates the sidewall coring tool assembly 12 deployed at the end of a wireline cable 20, in other embodiments, a sidewall coring tool assembly 12 may be deployed in a well using any known or future-developed conveyance means, including drill pipe, coiled tubing, etc.

In certain embodiments, the sidewall coring tool assembly 12 may be contained within an elongate housing suitable for being lowered into and retrieved from the borehole 16. In certain embodiments, the sidewall coring tool assembly 12 may include an electronic sonde 28, a coring module 30, and a core magazine 32. In general, the electronic sonde 28 includes electronics that enable the sidewall coring tool assembly 12 to communicate with the surface unit 22 (e.g., though the cables 20) and to control coring operations of the sidewall coring tool assembly 12 in accordance with such communication. In addition, the coring module 30 includes mechanical components that enable the sidewall coring tool assembly 12 to retrieve core samples through the sidewall 18 of the wellbore 16, as described in greater detail, and to store the retrieved core samples (e.g., as sequentially retrieved) in the core magazine 32.

In particular, as described in greater detail herein, the coring module 30 contains a coring assembly including at least one coring motor 34 powered through the cables 20, a (generally cylindrical) coring shaft 36 having a distal, open end 38 for cutting and receiving a core sample from a formation 14 into an internal cavity formed radially within the cylindrical coring shaft 36, and a mechanical linkage (not shown) for deploying and retracting the coring shaft 36 relative to the sidewall coring tool assembly 12 and for rotating the coring shaft 36 against the sidewall 18. FIG. 1 illustrates the sidewall coring tool assembly 12 in an active, cutting configuration. For example, the sidewall coring tool assembly 12 is positioned adjacent the formation 14 and urged firmly against the sidewall 18 of the wellbore 16 by upper and lower anchoring shoes 40, 42, which are extended from a side of the sidewall coring tool assembly 12 opposing the coring shaft 36. As described in greater detail herein, the distal, open end 38 of the coring shaft 36 may be rotated via the coring motor 34 against the formation 14 to cut a core sample from the formation 14.

In addition, as described in greater detail herein, the sidewall coring tool assembly 12 may include a downhole pump module 45 configured to move fluid from the annulus between the sidewall coring tool assembly 12 and the wellbore 16 to the coring module 30. The mud flow acts as lubrication and assists in moving the cuttings during coring operations away from the coring shaft 36 and helping with clean-up. In certain embodiments, the pumping rates and/or pumping direction may be adjustable in order to, for example, reduce the flow when coring relatively soft formations 14 and increase flow when coring relatively hard formations 14. In certain embodiments, before coring operations, mud flow enters from the wellbore 16, passes through screens to remove relatively large debris, and is pushed to the coring bit receptacle to flush any accumulated debris during the trip in the hole or between stations.

Figure 2A:
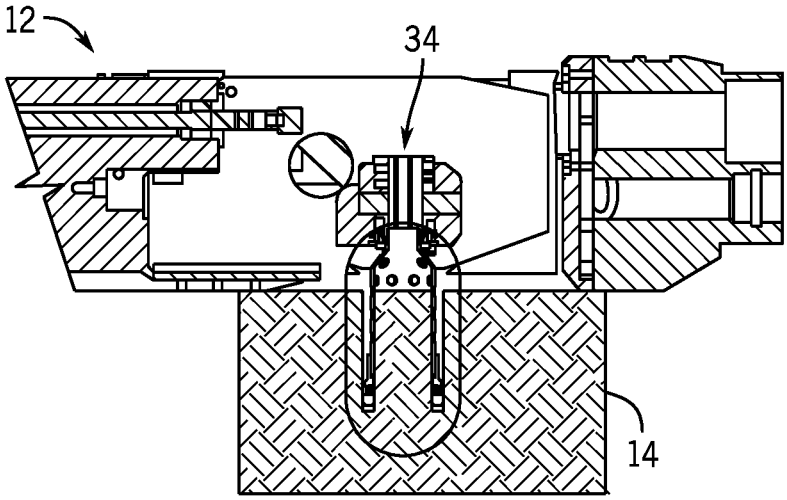
FIGS. 2A through 2C are schematic views of a sidewall coring tool assembly including close-up views of a coring shaft and coring bit, according to one or more embodiments of the present disclosure.
Figure 2B:
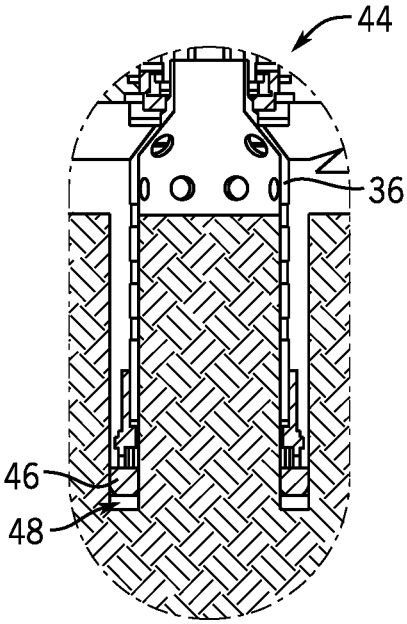
Figure 2C:
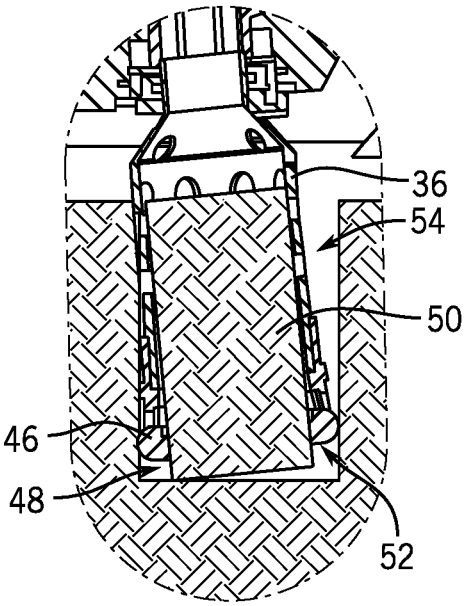

FIGS. 2A through 2C are schematic views of a sidewall coring tool assembly 12 including close-up views of the coring shaft 36 and the coring bit 46 of the sidewall coring tool assembly 12. A coring shaft 36 coupled via a (generally cylindrical) coring motor shaft 44 of the coring motor 34 transfers rotary power and weight-on-bit (WOB) during the cutting operation. The coring shaft 36 is attached to the coring motor shaft 44 at a first axial end and to a coring bit 46 at a second axial end. In general, the coring bit 46 includes a bit face 48 (e.g., rock and bit interface) that contacts the formation 14. In certain embodiments, a clearance between an internal diameter of the coring shaft 36 and an outer diameter of the core plug 50 forms an internal annulus 52, which provides an annular path for mud and cutting debris. Similarly, a clearance between an external diameter of the coring shaft 36 and an internal diameter of the formation 14 forms an external annulus 54, which provides another annular path for mud and cutting debris.

In general, without a defined or directed flow, the cuttings are free to move in any direction in the internal and external annuli, allowing the cuttings and debris to keep circulating in the internal annulus 52 and/or the external annulus 54. Depending on the properties of the drilling mud and formation 14, the cutting debris may clump around the coring bit 46 and/or the coring shaft 36, commonly referred to as bit balling. Bit balling may cause drilling problems like reduced rate of penetration or stalling of the coring motor 34. Too much bit balling could also cause the coring bit 46 to get stuck in the formation 14.

As such, for the coring bit 46 to advance into the formation 14, the cuttings generated by the coring bit 46 need to move away from the bit face 48 of the coring bit 46. In typical coring operations, the cutting action takes place in static wellbore fluid in contrast with other industrial cutting operations that use a flow of fluid to cool the tool and move cuttings away from the bit face 48. Again, when cutting without active fluid flow, the cuttings tend to accumulate around the coring bit 46 and the coring shaft 36, which can prevent fluid from reaching the bit face 48, reduce the rate of penetration, and result in jamming or stalling of the coring bit 46. Conventional coring bits may provide a restricted path to move the cuttings away from the bit face, which may not allow for the free flow of debris away from the bit face and results in the cuttings staying at the bit face where they are further reduced in size in what has been dubbed "re-grinding of cuttings" or "cutting of cuttings." This situation reduces the overall efficiency of the drilling operation. Coring tools may employ perforations in the coring shaft 36 to allow drilling mud and cutting debris to enter and exit between the internal and external annuli. During rotation of the coring shaft 36, the perforations create turbulence that causes movement of the drilling mud and cutting debris; however, there is no defined or directed flow of the mud or debris.

As described above, the embodiments described herein modify or add a downhole bi-directional pump module 45 to a sidewall coring tool assembly 12 in order to move fluid from the annulus between the sidewall coring tool assembly 12 and the wellbore 16 to the coring bit 46 of the sidewall coring tool assembly 12 and/or the recessed cavity where the coring bit 46 resides before it is deployed. The mud flow acts as lubrication and assists in moving the cuttings during coring operations away from the coring bit 46 and helping with clean-up. In certain embodiments, the pumping rates and/or pumping direction may be adjustable in order to, for example, reduce the flow when coring relatively soft formations 14 and increase flow when coring relatively hard formations 14. In certain embodiments, before coring operations, mud flow enters from the wellbore 16, passes through screens to remove relatively large debris, and is pushed to the coring bit receptacle to flush any accumulated debris during the trip in the hole or between stations.

Figure 3:
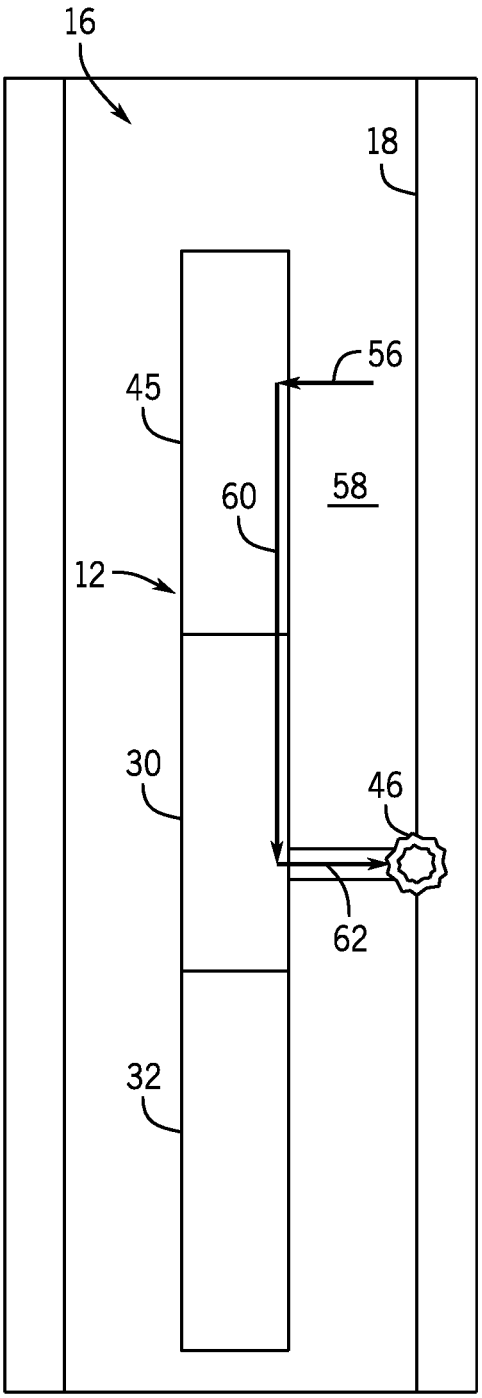
FIG. 3 illustrates a sidewall coring tool assembly having a downhole pump module, according to one or more embodiments of the present disclosure.

FIG. 3 illustrates a sidewall coring tool assembly 12 having a downhole pump module 45, as described in greater detail herein. As illustrated in FIG. 3, the downhole pump module 45 draws a portion 56 of mud 58 from the wellbore 16 and delivers it to the coring module 30 (as illustrated by arrow 60) and to or close to the coring bit 46 of the coring module 30 (as illustrated by arrow 62) during a coring operation. In addition, as described in greater detail herein, in certain embodiments, the downhole pump module 45 may include a bi-directional pump configured to pump the fluid from the downhole pump module 45 to the coring bit 46 of the coring module 30 and/or to pump the fluid back from the coring bit 46 of the coring module 30 to the downhole pump module 45. In addition, the pumping rates and/or pumping direction of the fluid (e.g., mud) through the downhole pump module 45 may be adjustable (e.g., automatically, in certain embodiments) in substantially real-time to enable the downhole pump module 45 to provide adjustable amounts of the fluid to and/or from the coring bit 46 of the coring module 30 based, for example, on current coring operating parameters. In general, the flow of fluid to the coring bit 46 of the coring module 30 helps cool/lubricate the coring bit 46 of the coring module 30 as well as move cuttings away from the coring operations.

Figure 4:
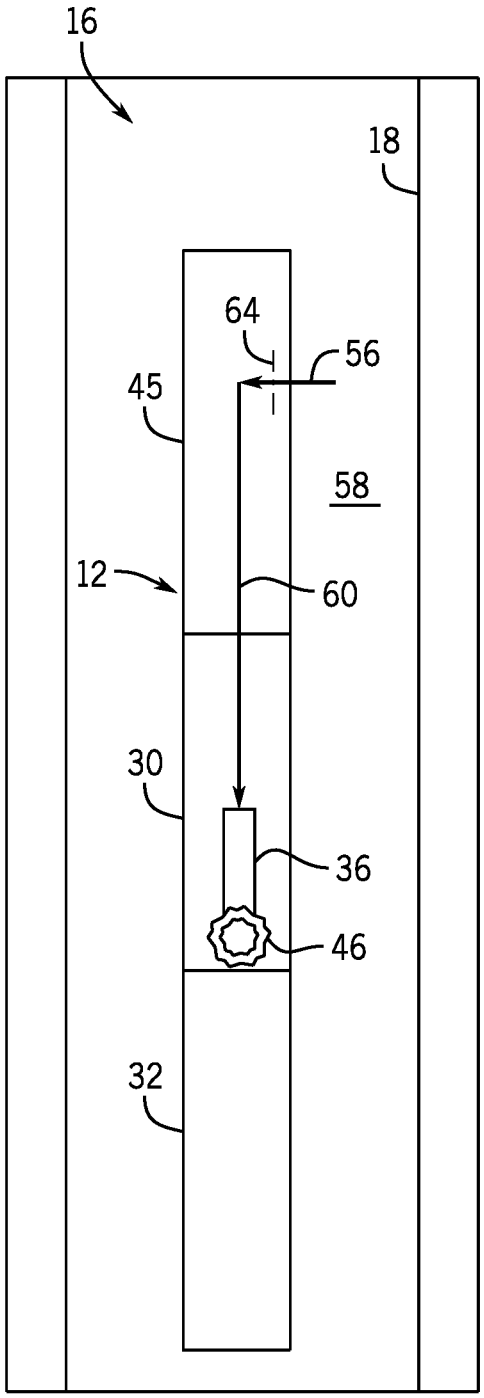
FIG. 4 illustrates another mode of operation of the downhole pump module of the sidewall coring tool assembly illustrated in FIG. 3, according to one or more embodiments of the present disclosure.

FIG. 4 illustrates another mode of operation of the downhole pump module 45 of the sidewall coring tool assembly 12 illustrated in FIG. 3. In particular, as illustrated in FIG. 4, in certain embodiments, during running of the sidewall coring tool assembly 12 into the wellbore 16 (e.g., either before a coring operation or while moving the sidewall coring tool assembly 12 between coring stations), the portion 56 of the mud 58 from the wellbore 16 may pass through one or more screens 64 to remove relatively large debris from the mud, and be delivered to the coring module 30 (as illustrated by arrow 60) to flush any accumulated debris from around and/or within the coring shaft 36 and/or coring bit 46 of the coring module 30.

As described herein, in certain embodiments, the pumping rates and/or pumping direction of mud to and/or from the coring shaft 36 and/or coring bit 46 of the coring module 30 may be adjustable in substantially real time during coring operations. For example, in certain embodiments, the pumping rates and/or pumping direction of mud to and/or from the coring shaft 36 and/or coring bit 46 of the coring module 30 may be adjustable in substantially real time during coring operations based at least in part on properties (e.g., volume and/or type) of cutting debris measured by one or more sensors located either at the surface (e.g., by the surface unit 22 measuring cutting debris in mud returned to the surface) or within the coring module 30 and/or the downhole pump module 45 (e.g., measuring cutting debris in the mud flowing through the coring module 30 and/or the downhole pump module 45). In such embodiments, for example, the surface unit 22 may receive data relating to the measured properties of the cutting debris, and may (e.g., automatically, in certain embodiments) send control signals to the downhole pump module 45 to (e.g., automatically, in certain embodiments) adjust pumping rates and/or pumping direction of mud through the downhole pump module 45 based at least in part on the measured properties of the cutting debris.

While the present disclosure may be susceptible to various modifications and alternative forms, specific embodiments have been shown by way of example in the drawings and have been described in detail herein. However, it should be understood that the present disclosure is not intended to be limited to the particular forms disclosed. For example, while some embodiments described herein contain specific combinations of coring systems, other combinations may also be possible. Rather, the present disclosure is intended to cover all modifications, equivalents, and alternatives falling within the spirit and scope of the present disclosure as defined by the following appended claims. In particular, it will be appreciated that any and all combinations and sub-combinations of the various features described herein may be included or omitted from any particular embodiment.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform] ing [a function] . . . " or "step for [perform] ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A sidewall coring tool assembly, comprising:

a coring tool configured to perform a sidewall coring operation to extract a core sample from a formation adjacent a borehole within which the sidewall coring tool assembly is disposed; and a downhole pump configured to control a flow of fluid through the coring tool, wherein the sidewall coring tool assembly further comprises at least one of:

the downhole pump being configured to automatically adjust a pumping rate and/or a pumping direction of the flow of the fluid through the coring tool in substantially real time during the sidewall coring operation; or one or more screens configured to remove debris from the flow of the fluid.

2. The sidewall coring tool assembly of claim 1, wherein the downhole pump is configured to bi-directionally control the flow of the fluid through the coring tool.

3. The sidewall coring tool assembly of claim 1, wherein the downhole pump is configured to automatically adjust the pumping rate of the flow of the fluid through the coring tool in substantially real time during the sidewall coring operation.

4. The sidewall coring tool assembly of claim 1, wherein the downhole pump is configured to automatically adjust the pumping direction of the flow of the fluid through the coring tool in substantially real time during the sidewall coring operation.

5. The sidewall coring tool assembly of claim 1, wherein the downhole pump is configured to automatically adjust the pumping rate and/or the pumping direction of the flow of the fluid through the coring tool in substantially real time during the sidewall coring operation based at least in part on one or more properties of cuttings in the flow of the fluid measured by one or more sensors of the sidewall coring tool assembly.

6. A coring system, comprising:

a sidewall coring tool assembly comprising:

a coring tool configured to perform a sidewall coring operation to extract a core sample from a formation adjacent a borehole within which the sidewall coring tool assembly is disposed; and a downhole pump configured to control a flow of fluid through the coring tool; and a surface unit configured to send control signals to the downhole pump to automatically adjust operating parameters of the downhole pump.

7. The coring system of claim 6, wherein the downhole pump comprises one or more screens configured to remove debris from the flow of the fluid.

8. The coring system of claim 6, wherein the downhole pump is configured to bi-directionally control the flow of the fluid through the coring tool.

9. The coring system of claim 6, wherein the downhole pump is configured to automatically adjust a pumping rate and/or a pumping direction of the flow of the fluid through the coring tool in substantially real time during the sidewall coring operation.

10. The coring system of claim 9, wherein the downhole pump is configured to automatically adjust the pumping rate of the flow of the fluid through the coring tool in substantially real time during the sidewall coring operation.

11. The coring system of claim 9, wherein the downhole pump is configured to automatically adjust the pumping direction of the flow of the fluid through the coring tool in substantially real time during the sidewall coring operation.

12. The coring system of claim 9, wherein the downhole pump is configured to automatically adjust the pumping rate and/or the pumping direction of the flow of the fluid through the coring tool in substantially real time during the sidewall coring operation based at least in part on one or more properties of cuttings in the flow of the fluid measured by one or more sensors.

13. The coring system of claim 12, wherein the one or more sensors are located at a surface location of the coring system.

14. The coring system of claim 12, wherein the one or more sensors are disposed in the sidewall coring tool assembly.

15. A sidewall coring tool assembly, comprising:

a coring tool configured to perform a sidewall coring operation to extract a core sample from a formation adjacent a borehole within which the sidewall coring tool assembly is disposed; and a downhole pump configured to bi-directionally control a flow of fluid through the coring tool.

16. The sidewall coring tool assembly of claim 15, wherein the downhole pump is configured to automatically adjust a pumping rate and/or a pumping direction of the flow of the fluid through the coring tool in substantially real time during the sidewall coring operation.

17. The sidewall coring tool assembly of claim 16, wherein the downhole pump is configured to automatically adjust the pumping rate of the flow of the fluid through the coring tool in substantially real time during the sidewall coring operation.

18. The sidewall coring tool assembly of claim 16, wherein the downhole pump is configured to automatically adjust the pumping direction of the flow of the fluid through the coring tool in substantially real time during the sidewall coring operation.

19. The sidewall coring tool assembly of claim 16, wherein the downhole pump is configured to automatically adjust the pumping rate and/or the pumping direction of the flow of the fluid through the coring tool in substantially real time during the sidewall coring operation based at least in part on one or more properties of cuttings in the flow of the fluid measured by one or more sensors of the sidewall coring tool assembly.

20. The sidewall coring tool assembly of claim 15, wherein the downhole pump comprises one or more screens configured to remove debris from the flow of the fluid.

* * * * *